US007742573B2

(12) United States Patent
Caiafa et al.

(10) Patent No.: US 7,742,573 B2
(45) Date of Patent: Jun. 22, 2010

(54) FAST SWITCHING CIRCUIT FOR X-RAY IMAGING APPLICATIONS

(75) Inventors: Antonio Caiafa, Niskayuna, NY (US); Colin Richard Wilson, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 12/253,438

(22) Filed: Oct. 17, 2008

(65) Prior Publication Data

US 2010/0098217 A1 Apr. 22, 2010

(51) Int. Cl.
*H05G 1/32* (2006.01)
*H05G 1/08* (2006.01)
*H05G 1/58* (2006.01)

(52) U.S. Cl. ..... 378/111; 378/91; 378/101; 378/112; 378/114

(58) Field of Classification Search ..... 378/91, 378/101, 111, 112, 114–116, 119, 210, 98, 378/98.9; 250/493.1; 315/160, 170–172, 315/209 CD, 209 R, 224, 225, 246–248, 315/291, 307, 362, 1, 107; 314/115, 135; 307/112; 363/59, 60
See application file for complete search history.

(56) References Cited

U.S. PATENT DOCUMENTS 4,247,774 A 1/1981 Brooks
4,361,901 A * 11/1982 Daniels et al. ..... 378/106
4,481,654 A * 11/1984 Daniels et al. ..... 378/110
5,490,196 A 2/1996 Rudich et al.
5,546,294 A * 8/1996 Schutten et al. ..... 363/17
5,661,774 A 8/1997 Gordon et al.
5,719,759 A * 2/1998 Wagner et al. ..... 363/132
6,072,856 A * 6/2000 Van Der Broeck et al. .. 378/101
6,205,200 B1 * 3/2001 Boyer et al. ..... 378/101
6,215,850 B1 * 4/2001 Blake et al. ..... 378/114
6,804,129 B2 * 10/2004 Lin ..... 363/98
6,898,089 B2 * 5/2005 Oates ..... 363/17
7,236,559 B2 6/2007 Jha et al.
7,298,812 B2 11/2007 Tkaczyk et al.
2004/0007990 A1 * 1/2004 Kitaoka ..... 315/209 CD
2005/0078794 A1 * 4/2005 Leek ..... 378/111
2008/0018265 A1 * 1/2008 Lee et al. ..... 315/291
2008/0260101 A1 * 10/2008 Oreper ..... 378/134

FOREIGN PATENT DOCUMENTS

WO 92/02892 A1 2/1992
WO 2007/017773 A2 2/2007

* cited by examiner

*Primary Examiner*—Edward J Glick
*Assistant Examiner*—Anastasia Midkiff
(74) *Attorney, Agent, or Firm*—Joseph J. Christian

(57) ABSTRACT

A system is provided, which includes a rotatable gantry for receiving an object to be scanned. The system includes an x-ray source for projecting x-rays of two different energy levels towards the object and also a power supply, which energizes the x-ray source to two different voltage levels at a predetermined rate for generating x-rays at two different energy levels. The power supply in the system includes a fixed voltage source to input a voltage to a switching module with number of identical switching stages. Each stage in the switching module consists of a first switch, which charges a capacitor in a conducting state and output a first voltage, a second switch, which connects the fixed voltage source and the capacitor in series to output a second voltage in a conducting state and a diode which blocks a reverse current from the capacitor to the power supply.

22 Claims, 5 Drawing Sheets

FAST SWITCHING CIRCUIT FOR X-RAY IMAGING APPLICATIONS

BACKGROUND

The invention relates generally to a fast switching circuit and more specifically to a fast switching circuit between two voltage levels within a dual energy x-ray system.

An x-ray baggage scanner may be used to detect the presence of an explosive device in baggage. The scanner issues an alarm if it detects the explosive device. Every false alarm requires a suspect bag to be searched by a security guard. Consequently, it is important to develop scanners that keep the number of false alarms as low as possible. This ensures low operating costs and maximum baggage throughput. One type of technique used in the x-ray baggage scanner is a technique called material decomposition. Material decomposition allows the effective atomic number of material to be measured when the baggage is scanned by the baggage scanner. An explosive material is generally characterized by a relatively high atomic number and is therefore easy to detect by material decomposition.

Material decomposition involves measuring an x-ray absorption characteristic of a material for two different energy levels of x-rays. Alternating beam type is one type of scanner, which generates two different energy levels of x-rays. However, the two energy levels generated by this scanner are not much different from each other. Thus, accurate analysis of the atomic number of the object being scanned is not possible. Dual detector type is another type of scanner, which generates two different energy levels. However, this scanner also doesn't produce two significantly different energy levels and further needs two detector arrays rather than a single detector array.

Two different energy levels of x-rays can also be generated by applying two different voltage levels to the x-ray source. In this case, a power supply supplies two different voltages changing rapidly between two different high voltage levels to the x-ray source. However, the power supplies currently used for the x-ray source have a slow time response due to a cable capacitance of a cable between the power supply and the x-ray source. Therefore, it would be desirable to design a fast switching circuit that would address the foregoing issues.

These and other advantages and features will be more readily understood from the following detailed description of preferred embodiments of the invention that is provided in connection with the accompanying drawings.

BRIEF DESCRIPTION

In accordance with one exemplary embodiment of the invention, a system is provided, which includes a rotatable gantry for receiving an object to be scanned. The system also includes an x-ray source for projecting x-rays having a first energy and a second energy towards the object and also a power supply, which energizes the x-ray source to a first voltage and a second voltage at a predetermined rate for generating x-rays at two different energy levels. The power supply in the system includes a fixed voltage source to input a voltage to a switching module with number of identical switching stages. Each stage in the switching module consists of a first switch, which charges a capacitor in a conducting state and output the first voltage, a second switch, which connects the fixed voltage source and the capacitor in series to output the second voltage in a conducting state and a diode which blocks a reverse current from the capacitor to the power supply.

In accordance with another embodiment of the invention, a power supply having a fixed voltage source for inputting a voltage to a switching module is provided. The switching module includes a number of identical switching stages. Each stage in the switching module consists of a first switch configured to charge a capacitor in a conducting state and output the first voltage, a second switch configured to connect the fixed voltage source and the capacitor in series to output the second voltage in a conducting state, and a diode for blocking a reverse current from the capacitor to the power supply.

In accordance with yet another embodiment of the invention, a method for generating an x-ray image is provided. The method includes first projecting a beam of x-ray energy having a first voltage towards an object and then acquiring a first set of measured projections. The method further includes switching from the first voltage to a second voltage and projecting a beam of x-ray energy having a second voltage toward the object. A second set of measured projection is again acquired and the x-ray image from the first set of measured projection and the second set of measured projection is constructed. The switching from the first voltage to the second voltage is done by charging at least one capacitor from a fixed voltage source by a first switch and outputting the first voltage and then connecting the at least one capacitor and the fixed voltage source in series by a second switch and outputting the second voltage. A diode is then used for blocking a reverse current from the at least one capacitor to the fixed voltage source.

These and other advantages and features will be more readily understood from the following detailed description of preferred embodiments of the invention that is provided in connection with the accompanying drawings.

DRAWINGS

DETAILED DESCRIPTION

As discussed in detail below, embodiments of the present technique provide a power supply, a method and a system for fast switching between two voltage levels within a dual energy x-ray system. Although the present discussion focuses on x-ray imaging systems for use with a baggage scanning system, it is applicable to any x-ray imaging system, such as a medical CT scanner.

Figure 1:
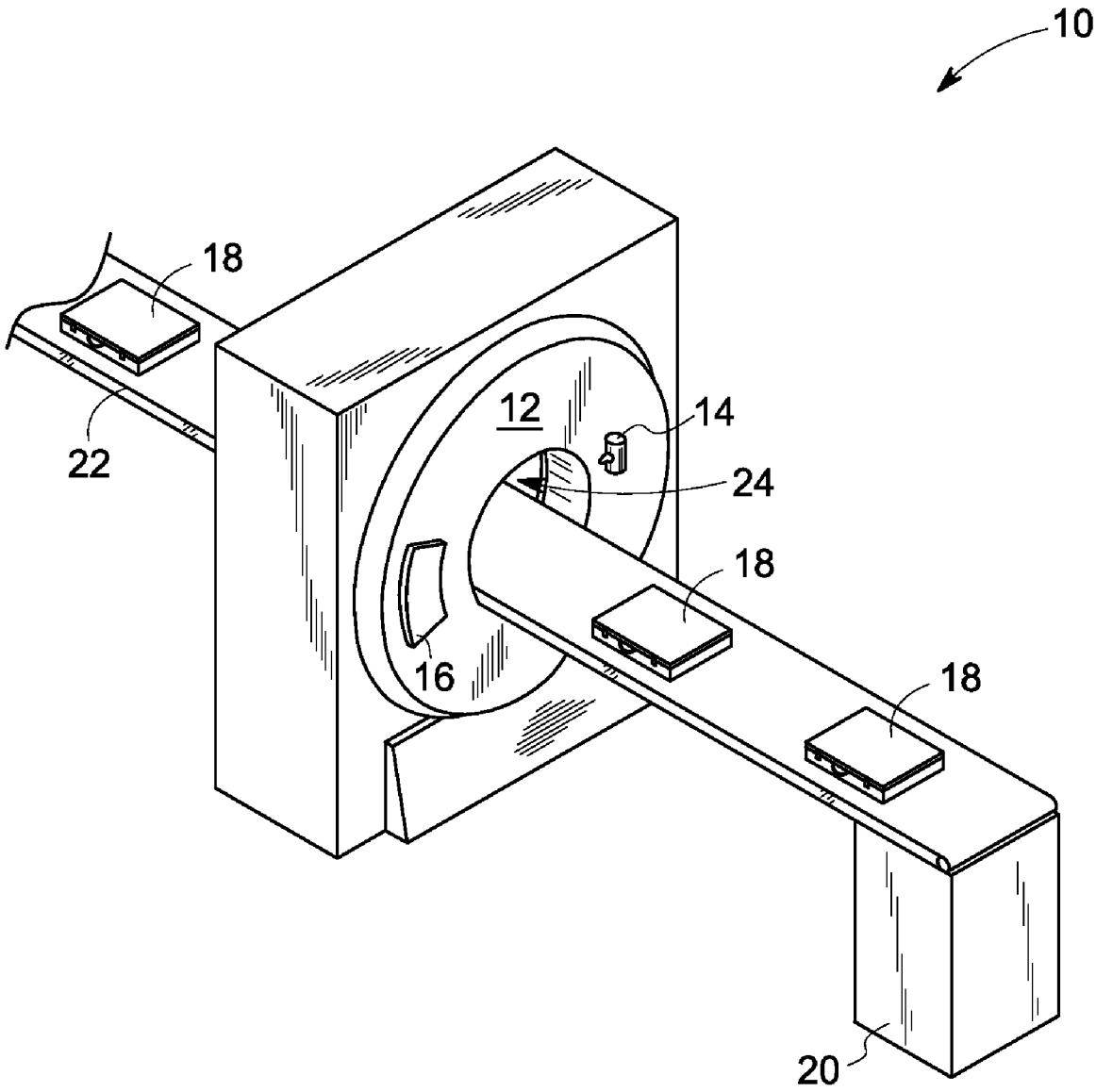
FIG. 1 is a pictorial view of an x-ray imaging system for use with a baggage screening system according to an embodiment of the invention.

Referring now to the drawings, FIG. 1 is a pictorial view of an x-ray imaging system 10 for use with a baggage screening system according to an embodiment of the invention. The system includes a rotating gantry 12 representative of a CT scanner for scanning baggage, parcels, and packages. The gantry 12 has an x-ray source 14 that projects a beam of x-rays (not shown) towards a detector array 16 on the opposite side of the gantry 12. The detector array 16 is formed by a plurality of detectors, which together sense the projected x-rays that pass through an object 18. A motor (not shown) provides a motive power for rotating the gantry around the object 18 to be scanned. The system includes a conveyor belt system 20 and a conveyor belt 22, which passes the objects through the gantry opening 24. The conveyor belt system 20 continuously passes packages or baggage pieces 18 through the gantry opening 24 to be scanned. Objects 18 are fed through the gantry opening 24 by conveyor belt 22, imaging data is then acquired, and the conveyor belt 22 removes the packages 18 from the opening 24 in a controlled and continuous manner. As a result, postal inspectors, baggage handlers, and other security personnel may non-invasively inspect the contents of packages 18 for explosives, knives, guns, contraband, etc.

Figure 2:
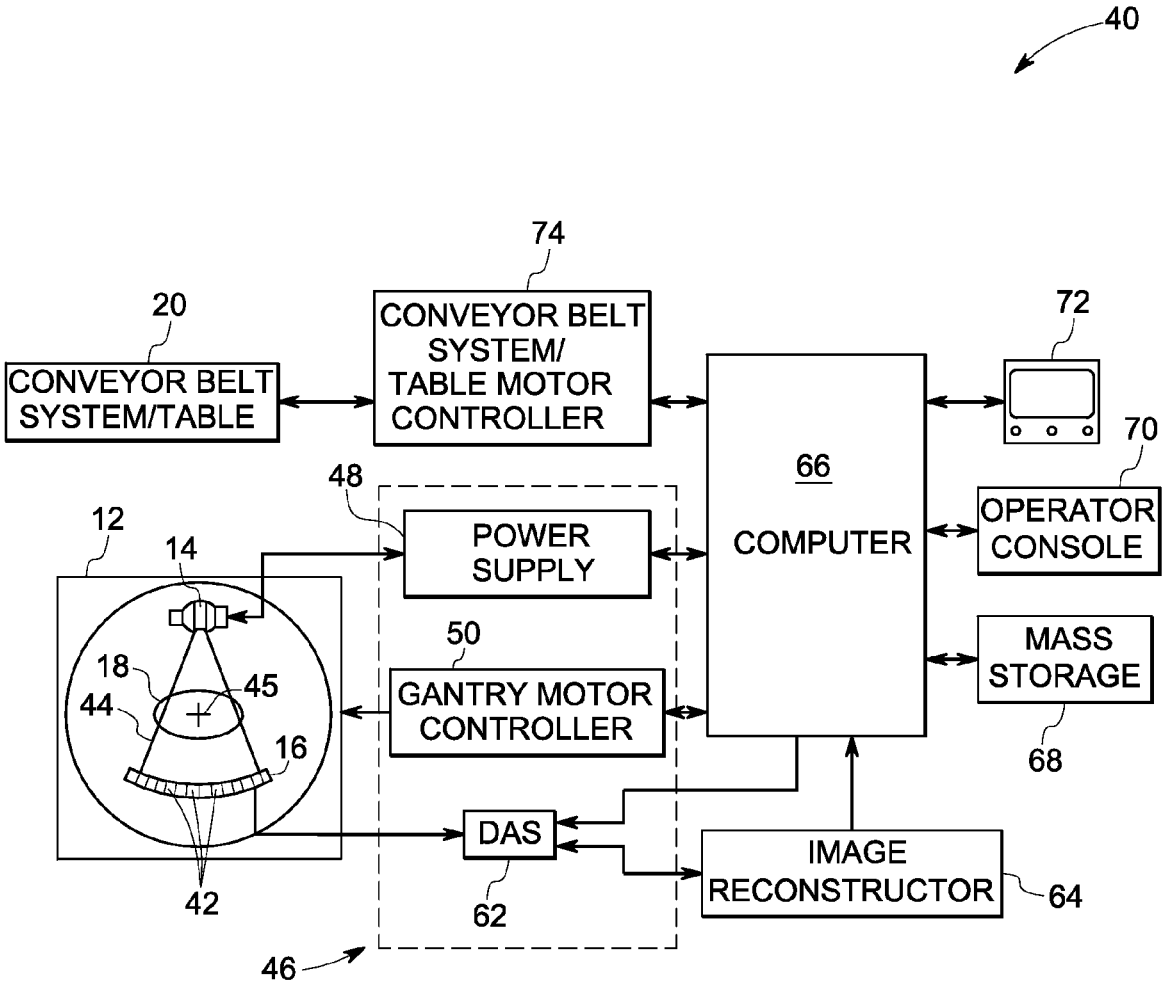
FIG. 2 is a block diagram of the system illustrated in FIG. 1.

FIG. 2 is a block diagram 40 of the x-ray imaging system 10 shown in FIG. 1. It shows the gantry 12, an x-ray source 14, such as or an x-ray tube, the detector array 16 and the object 18 of FIG. 1. As described earlier, the detector array is formed by plurality of detectors 42. The plurality of detectors 42 sense the projected x-rays 44 by the x-ray source 14, that passes through the object 18. Each detector 42 produces an electrical signal that represents the intensity of an impinging x-ray beam and hence the attenuated beam as it passes through the object 18. In one embodiment the detector 42 may be an energy integrating detector or a photon counting energy discriminating detector. During a scan to acquire x-ray projection data, the gantry 12 and the components mounted thereon rotate about a center of rotation 45.

Rotation of the gantry 12 and operation of the x-ray source 14 are governed by a control mechanism 46 of the CT system. The control mechanism 46 includes a power supply 48 that provides voltages with appropriate timings to the x-ray source 14. In one embodiment, the power supply provides two different voltages levels to the x-ray source 14. Thus, the x-ray source generates two x-rays of two different energy levels for material decomposition. The control mechanism 46 further includes a gantry motor controller 50 that controls the rotational speed and position of gantry 12. A data acquisition system (DAS) 62 in the control mechanism 46 samples analog data from detectors 42 and converts the data to digital signals for subsequent processing. An image reconstructor 64 receives a sampled and digitized x-ray data from the DAS 62 and performs a high-speed image reconstruction. The reconstructed image is applied as an input to a computer 66, which stores the image in a mass storage device 68.

The computer 66 also receives commands and scanning parameters from an operator via console 70 that has a keyboard. An associated cathode ray tube display 72 allows the operator to observe the reconstructed image and other data from the computer 66. The commands and the parameters supplied by the operator are used by the computer 66, to provide control signals and information to the DAS 62, the x-ray controller 48 and the gantry motor controller 50. In addition, the computer 66 operates a conveyor belt system motor controller 74, which controls a motorized conveyor belt system 20 to pass objects 18 through the gantry opening 24 of FIG. 1.

Figure 3:
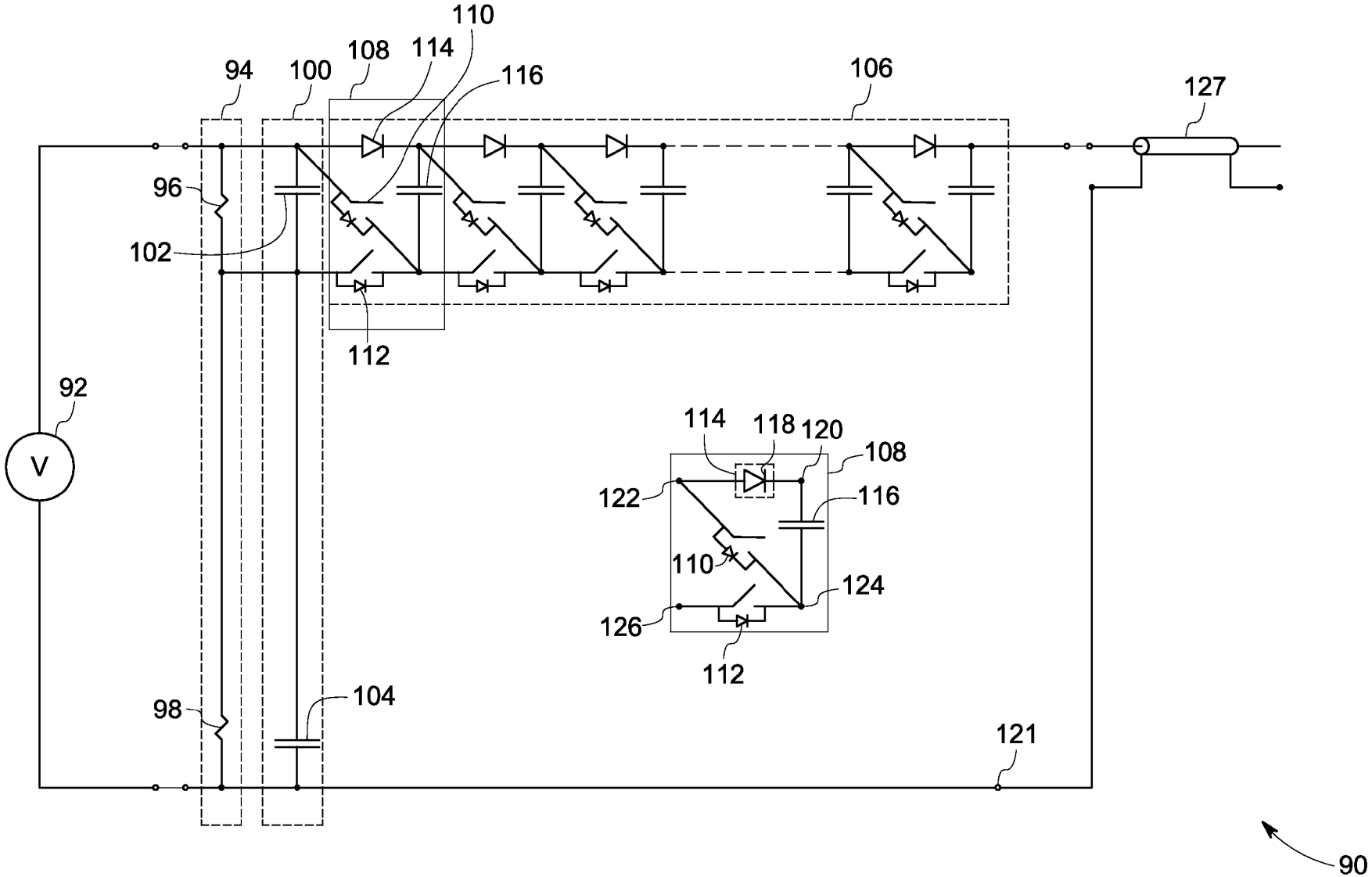
FIG. 3 is a schematic representation of a fast switching circuit according to an embodiment of the invention.

FIG. 3 is a schematic representation 90 of one preferred embodiment of the power supply 48 of FIG. 2. As explained earlier, the power supply generates a first and a second voltage level and applies them to the x-ray source. The power supply includes a fixed voltage source 92 or a high voltage DC supply. A resistor divider circuit 94 made of two resistors 96, 98 connected in series is connected in parallel with a capacitor divider circuit 100 made of two capacitors 102, 104. The fixed voltage source 92 is connected across the parallel combination of resistor divider circuit 94 and the capacitor divider circuit 100. A switching module 106 is then connected in parallel with the capacitor 102 of the power supply. Each switching module 106 consists of a number of identical switching stages 108 connected in parallel. Each switching stage 108 in the switching module 106 includes a first switch 110, a second switch 112, a diode 114 and an output capacitor 116. The number of identical stages is determined based on a difference between the first voltage and the second voltage and a voltage across one switching stage. The cathode 118 of the diode 114 is connected to the positive terminal 120 of the output capacitor 116. The negative terminal 124 of the output capacitor 116 and the cathode 118 of the diode 114 forms the output terminals for the switching stage 108 and the anode 122 of the diode 114 and a first terminal 126 of the second switch 112 forms the input terminals for the switching stage 108. The first switch 110 is connected in between anode 122 of the diode 114 and the negative terminal 124 of the output capacitor 116. In one embodiment, the switch is an insulated gate bipolar transistor (IGBT) or a metal oxide semiconductor field effect transistor (MOSFET). In one embodiment, the first switch 110 and the second switch 112 are turned on and turned off by a gate drive circuit for a proper operation. The output voltage of the power supply 48 is measured across the positive terminal 120 of the output capacitor 116 of the last switching stage 108 and a negative terminal 121 of the second capacitor 104 of the capacitor divider circuit 100. FIG. 3 shows a cable 127, which transmits the output voltage generated by the power supply 48 to the x-ray source 14.

In operation, the fixed voltage source 92 charges the capacitors 102 and 104. In one embodiment, the capacitors 102 and 104 have same capacitance value. Thus, each capacitor is charged to half the voltage of the fixed voltage source. However, other values for the capacitors 102 and 104 can be used depending on the desired division of the voltage across the capacitors 102 and 104. For an example, voltage of the fixed voltage source is V and the voltage across each capacitor 102 and 104 is $V_1$. Resistors 96 and 98, act like balancing resistors i.e., they act like voltage dividers and counteract the effects of variance in capacitance values and leakage currents of the capacitors 102 and 104.

For the transition from a high voltage to a very high voltage, initially, the second switch 112 in each of the switching stage 108 is in on state and the first switch 110 in each of the switching stage 108 is in off state. Voltage $V_1$ is then applied across the first switching stage 108. All output capacitors 116 of each switching stage 108 are then connected in parallel to the capacitor 102 and thus get charged to voltage $V_1$ through diode 114 of each switching stage 108. The diodes 114 are positively biased in this state. The output voltage of the power supply 48 is a low voltage of V in this state. Once all the capacitors are charged to voltage $V_1$, a first command signal to turn off the second switch 112 of all switching stages 108 is generated and executed. In one embodiment, the switches are ordered to turn off in sequence. In another embodiment, the switches are ordered to turn off simultaneously. The command signal, in one embodiment, is generated by an analog circuit. In another embodiment, the command signal is generated by appropriate programming of a digital processor.

A second command signal to turn on the first switch 110 of each switching stage 108 is generated after execution of the first command. As explained earlier with respect to first command signal, second command signal can also be generated by an analog circuit or by appropriate programming of a digital processor. In one embodiment, the first switches 110 are turned on in sequence, either from left to right or from right to left. In this embodiment, the sum of the times in between the turn on of two consecutive steps is equal to the "step-up" transition time. The "step-up" transition time being defined as the time needed to go from the high voltage to the very high voltage. In another embodiment, the first switches 110 are turned on simultaneously. In this embodiment, the transition from the high voltage to the very high voltage is much faster. However, the transferred energy is lower in this embodiment. Turning on of all first switches 110 in the power supply 48, results in all capacitors 116 getting connected in series. The diodes 114 are negatively biased in this state and block reverse currents from the capacitors to the fixed voltage source. The output of the power supply 48 is then a very high voltage $V_o$ given by the following equation:

$$V_o = V + n * V_1 * \alpha \quad (1)$$

where, n is a number of capacitors 102 used in the circuit and V is the voltage of the fixed voltage source, $V_1$ is the voltage across a single stage, and $\alpha$ is a coefficient that takes into account the energy losses during transition ($\alpha$ being less than 1). Thus, the transition from the high voltage V to the very high voltage $V_o$ of the power supply 48 is completed.

Turning to the switching sequence from the very high voltage $V_o$ to the high voltage V, initially all the capacitors 116 are in charged state and the voltage across each capacitor 116 is $V_1$. The first switch 110 in each of the switching stage 108 is in on state and the second switch 112 in each of the switching stage 108 is in off state. Thus, the output voltage of the power supply 48 is $V_o = V + n * V_1 * \alpha$. A first command signal to turn off the first switch 110 in each of the switching stage 108 is generated and executed. As in earlier cases, the switches can be turned on sequentially or simultaneously. A second command signal to turn on the second switch 112 in each of the switching stage 108 is then generated and executed. Again, the switches can be turned on sequentially or simultaneously. When the switches are turned on sequentially, the sum of the times in between the turn on of two consecutive steps is equal to the "step-down" transition time. The "step-down" transition time being defined as the time needed to go from the very high voltage 154 to the high voltage 146. The first command signal and the second command signal can be generated by an analog circuit or by appropriate programming of a digital processor. Once all first switches 110 are turned off and all the second switches 112 are turned on, the output voltage of the power supply becomes V and thus the transition from the very high voltage to the high voltage is achieved. It should be noted that even though the power supply 48 is described here for switching between two voltage levels, it can be used for switching between more than two levels.

The number n of capacitors 116 needed in the power supply 48 depends on the desired high voltage and the desired very high voltage. The fixed voltage source is chosen such that it's output voltage is equal to the low voltage. The number of capacitors 116, n is then given by:

$$n = \frac{Vo - V}{V_1 * \alpha} \quad (2)$$

It should be noted here that the number of total capacitors n does not include the capacitors used for the capacitor divider circuit 100. As will be appreciated by those skilled in the art, the capacitor value is determined based on a maximum capacitor current and a rate of voltage drop. The voltage ratings of the first switch, the second switch, the capacitor, and the diode are determined based on voltage across the switching stage 108. The coefficient $\alpha$ in equation (2) is less 1 and it depends on the step-up and step-down technique applied as well as the size of the capacitors.

Figure 4:
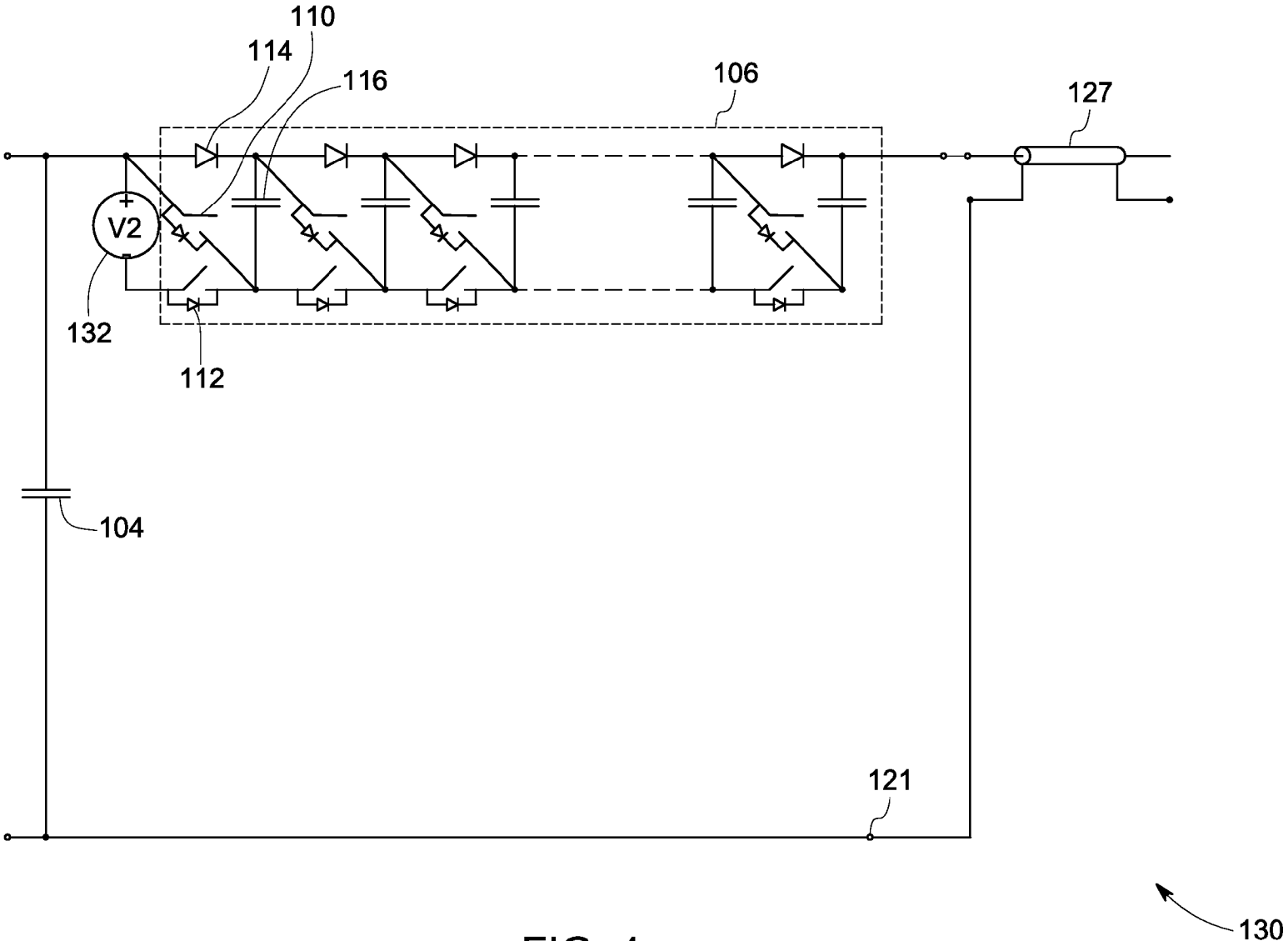
FIG. 4 is another schematic representation of a fast switching circuit according to an embodiment of the invention.

FIG. 4 is a schematic representation 130 of another embodiment of the power supply 48 of FIG. 2. In this embodiment, a second voltage source 132 is connected across the switching module 106. In other words, the resistor divider circuit 94 of FIG. 3 is replaced by the voltage source 132. The advantage of using the voltage source 132 instead of resistor divider circuit 94 is the circuit 130 becomes more efficient. Further, as there are fewer components in the circuit 130 compared to the circuit 90 of FIG. 3, the circuit 130 is more reliable and the output voltage levels are also stiff.

Figure 5:
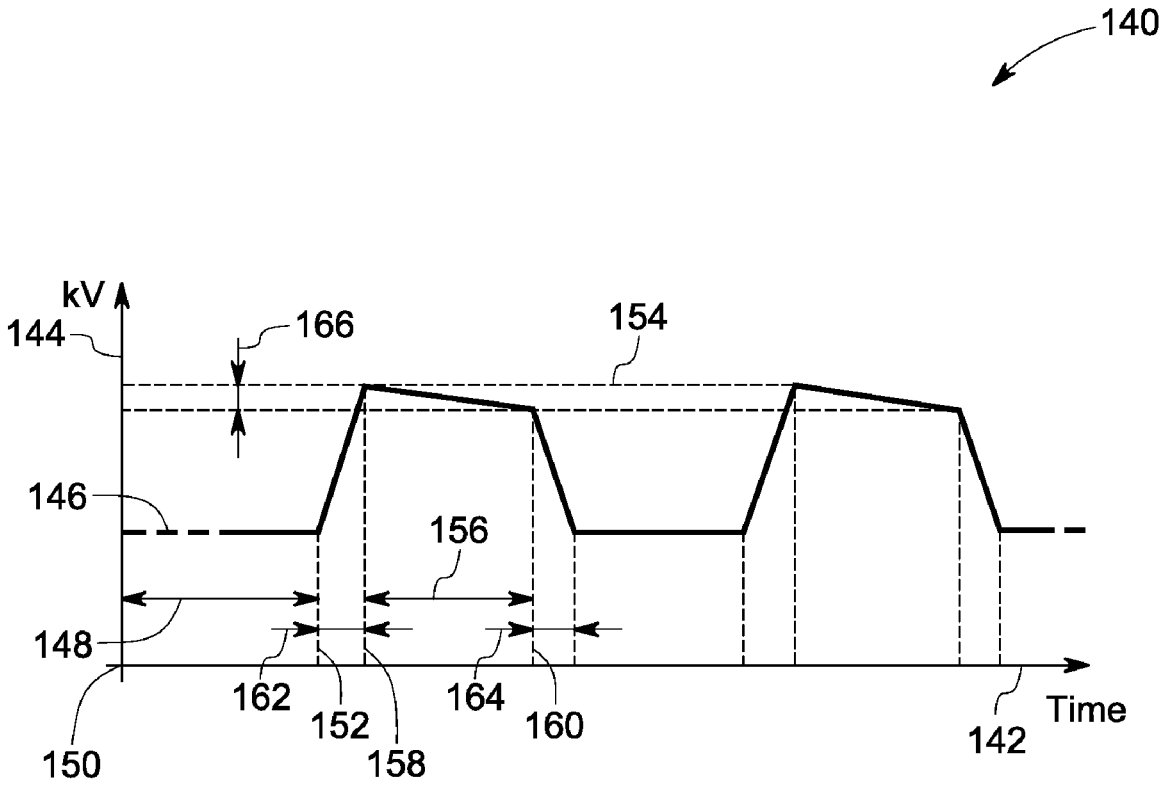
FIG. 5 is a plot of output voltage of the fast switching circuit.

FIG. 5 a plot of output voltage 140 generated by the power supply 48 of FIG. 2. Horizontal axis 142 in the plot represents time and vertical axis 144 represents voltage. As can be seen in the plot, the power supply 48 of the FIG. 2, provides a first voltage 146 or high voltage to the x-ray source 14 of FIG. 2 for a first duration 148, starting at or before a time 150 and providing the first voltage 146 until a time 152. After the first duration 148, the power supply 48 provides a second voltage 154 or very high voltage to the x-ray source 14 for a second duration 156, starting at a time 158 and providing the second voltage 154 until a time 160. After the second duration 156, the power supply 48 may again repeat the sequence. In one embodiment of the invention, the first voltage 146 is 80 kV and the second voltage 154 is 140 kV. However, it should be noted that these are just exemplary numbers and other voltage values are in scope of the invention.

As the first and second switches 110, 112 of the power supply 48 are turned on or turned off sequentially, the transition from the first voltage 146 to the second voltage 154 is not instantaneous. FIG. 4 shows a turn on time 162 for a transition from first voltage 146 to the second voltage 154 and also a turn off time 164 for a transition from second voltage 154 to the first voltage 146. Even if the first and second switches 110, 112 are turned on and turned off sequentially, there will be turn on and turn off times because of capacitive and other effects. FIG. 4 also shows a drop 166 in voltage for the second duration 156 from the time 158 to the time 160. During the duration 156, the capacitors 116 supply energy to the x-ray source 14 and thus the voltage drops by a certain amount. In one embodiment, the turn on and turn off times 162, 164 are in the order of microseconds or tens of microseconds and the durations 148, and 156 are from tens of microseconds to milliseconds; the duty cycle of the voltage waveform is in the order of 50 percent. However, it should be noted that these are just exemplary numbers and other time durations and duty cycles are in scope of the invention.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed as new and desired to be protected by Letters Patent of the United States is:

1. A system, comprising:

a rotatable gantry for receiving an object to be scanned;

an x-ray source configured to project x-rays having a first energy and a second energy toward the object; and a power supply configured to energize the x-ray source to a first voltage and a second voltage at a predetermined rate;

wherein the power supply comprises a fixed voltage source configured to input a voltage to a switching module having a number of identical switching stages comprising:

a first switch configured to charge a capacitor in a conducting state and output the first voltage;

a second switch configured to connect the fixed voltage source and the capacitor in series to output the second voltage in a conducting state; and a diode configured to block a reverse current from the capacitor to the power supply.

2. The system of claim 1, comprising a baggage scanning system or a medical scanner system.

3. The system of claim 1, wherein the rotatable gantry has an opening to receive the object to be scanned.

4. The system of claim 1, wherein the first switch and the second switch comprises MOSFETs or IGBTs.

5. The system of claim 1, wherein the second voltage is higher than the first voltage.

6. The system of claim 1, wherein the first voltage is approximately 80 kV and the second voltage is approximately 140 kV.

7. The system of claim 1, wherein the power supply is configured for a transition from the first voltage to the second voltage within a time of approximately 10 microseconds.

8. The system of claim 1, wherein the capacitor value is determined based on a maximum capacitor current and a rate of voltage drop.

9. The system of claim 1, wherein the number of identical switching stages is determined based on a difference between the first voltage and the second voltage and a voltage across one switching stage.

10. The system of claim 9, wherein the voltage across one switching stage determines voltage ratings of the first switch, the second switch, the capacitor, and the diode.

11. The system of claim 1, wherein the first switch and the second switch are turned on or turned off by a gate driver.

12. The system of claim 1, wherein the first switch and the second switch are not in the conducting state simultaneously.

13. A power supply, comprising:

a fixed voltage source configured to input a voltage to a switching module having a number of identical switching stages, wherein the identical switching stage comprises:

a first switch configured to charge a capacitor in a conducting state and output a first voltage;

a second switch configured to connect the fixed voltage source and the capacitor in series to output a second voltage in a conducting state; and a diode configured to block a reverse current from the capacitor to the power supply.

14. The system of claim 13, wherein the second voltage is higher than the first voltage.

15. The system of claim 13, wherein the first switch and the second switch are not in the conducting state simultaneously.

16. The system of claim 13, wherein the number of identical switching stages is determined based on a difference between the first voltage and the second voltage and a voltage across one switching stage.

17. A method of generating an x-ray image, comprising:

projecting a beam of x-ray energy having a first voltage toward an object;

acquiring a first set of measured projections;

switching from the first voltage to a second voltage;

projecting a beam of x-ray energy having a second voltage toward the object;

acquiring a second set of measured projection; and constructing the x-ray image from the first set of measured projections and the second set or measured projections, wherein switching from the first voltage to the second voltage comprises:

charging at least one capacitor from a fixed voltage source by a first switch and outputting the first voltage;

connecting the at least one capacitor and the fixed voltage source in series by a second switch and outputting the second voltage; and blocking a reverse current from the at least one capacitor to the fixed voltage source by a diode.

18. The method of claim 17, wherein the second voltage is higher than the first voltage.

19. The method of claim 17, wherein said charging the at least one capacitor comprises turning on the first switch and turning off the second switch.

20. The method of claim 17, wherein said connecting the at least one capacitor and the fixed voltage source in series comprises turning off the first switch and turning on the second switch.

21. The method of claim 17, comprising determining explosive material characteristics of the object.

22. The method of claim 21, wherein said determining explosive material characteristics of the object comprises determining an effective atomic number of the object material.

* * * * *